United States Patent [19]

Lemon

[11] 3,978,906

[45] Sept. 7, 1976

[54] PROCESS FOR THE RAPID PRODUCTION OF FOUNDRY MOLDS AND CORES AND TO A COMPOSITION FOR USE THEREIN

[75] Inventor: Peter Herbert Richard Bryan Lemon, Sherfield, England

[73] Assignee: Borden, Inc., Columbus, Ohio

[22] Filed: Sept. 11, 1975

[21] Appl. No.: 612,363

[30] Foreign Application Priority Data

Sept. 24, 1974 United Kingdom ..... 4158/74

[52] U.S. Cl. ..... 164/39; 164/41; 164/43; 164/138; 164/203; 260/3

[51] Int. Cl.[2] ..... B22C 9/02; B22C 1/16; B22C 15/10

[58] Field of Search ..... 164/15, 12, 41, 43, 164/21, 39, 138, 203, 200; 260/42.14, DIG. 40, 3

[56] References Cited

UNITED STATES PATENTS

| | | | |
|---|---|---|---|
| 2,726,431 | 12/1955 | Ensign et al. | 164/39 |
| 2,795,022 | 6/1957 | Shaw et al. | 164/12 |
| 2,976,589 | 3/1961 | Hackett et al. | 164/12 |
| 3,446,265 | 5/1969 | Buck et al. | 164/39 |
| 3,590,906 | 7/1971 | Kiddermeister et al. | 164/200 |
| 3,692,733 | 9/1972 | Johnson et al. | 260/DIG. 40 |
| 3,726,954 | 4/1973 | Munk et al. | 164/200 |
| 3,925,271 | 12/1975 | Balinth | 260/3 |

*Primary Examiner*—Leonidas Vlachos
*Attorney, Agent, or Firm*—Daniel D. Mast; George P. Maskas; George A. Kap

[57] ABSTRACT

A contact adhesive that is a polymeric material with a major proportion of a tackifier is applied to sand in making a foundry mold. No curing step for the adhesive is required but instead pressure is applied to get the desired bonding together of the sand granules.

6 Claims, No Drawings

PROCESS FOR THE RAPID PRODUCTION OF FOUNDRY MOLDS AND CORES AND TO A COMPOSITION FOR USE THEREIN

This invention relates to a process for the production of foundry molds and cores and to a foundry molding mixture for use therein.

Although a large number of processes is known for the production of foundry molds and cores, these may conveniently be classified in one of two categories.

The first, commonly referred to as greensand molding, makes use of a clay and water to bind refractory granules. In greensand molding, the mixture is simply rammed, either by hand or using a so-called "jolt-squeeze machine," into a core box or pattern mold. After removal of the pattern, the resultant mold may be immediately employed to produce a casting. When the casting has been made, the molding material may be broken up and rendered suitable for re-use by the simple addition of water to replace that lost by evaporation during the casting process. The greensand molding process is thus characterized by its simplicity, since no complex equipment is required, and its low cost, since it requires no oven curing. There is, moreover, no limiting bench life and no costly reclamation process is required.

The greensand molding process, however, has a number of disadvantages. Chief among these are the low strengths obtainable (generally only 70–140 kN/m$^2$) and the presence of water. As a consequence of the low strengths of greensand molds, the latter are generally confined to relatively simply shapes and to molds of relatively thick cross-section. They are also readily damaged. The presence of water leads to casting defects such as scabbing and, to minimize these, recourse is frequently had to time consuming drying procedures, thus negating some of the advantages of the process.

The second major category of foundry mold-making processes comprises a large number of procedures which have in common the use of a "convertible" binder, that is to say, a binder which can be converted irreversibly by suitable treatment from one physical state to another. As examples of convertible binders we may cite linseed oil binders, which can be solidified by heating or, with the addition of suitable accelerators, driers and the like, by air-drying; silicate binders, which are generally hardened by means of carbon dioxide gas blown through the mold or core and synthetic resin binders, such as phenolic resins, urea-formaldehyde/-furfuryl alcohol condensates and polyurethane precursors, which may be cured by the addition of a hardening agent, by heating or by passage of gas through the body of the mold or core.

Although this second category of foundry molding processes encompasses a very wide range of materials and procedures, it is generally characterized by the disadvantage that the molding composition cannot be recycled after the casting operation without an inconvenient and often costly and time consuming reclamation process. In addition, the several processes each have specific disadvantages related to the conversion procedures which they employ. Thus, these which make use of the heat setting property of binders require the use of ovens or of heated pattern molds or core boxes. Cold-setting systems, on the other hand, while avoiding some of the disadvantages associated with heat-setting binders, have a limited working life and frequently require the use of complex metering equipment to ensure the correct proportioning of a hardener component. The hardener component, moreover, is frequently a highly reactive chemical having corrosive and/or toxic properties. Systems employing the passage of a gas through the mold or core body demand special pattern molds or core boxes provided with gassing points. In some cases the process requires completely enclosed equipment to prevent the escape of noxious gases into the working environment.

There is thus a demand for a foundry mold making process which is as simple to employ as the traditional greensand process but which provides molds of higher strength and avoids the various aforementioned disadvantages.

We have now found that certain contact adhesives may be coated on to refractory granules to provide a mold-making composition which may be shaped by ramming to provide a mold which may be subjected to casting without further treatment and which may be recycled with little loss and without requiring a complex reclamation step.

Accordingly, the present invention provides a process for the production of foundry molds and cores which comprises coating a granular refractory material with a contact adhesive binder composition comprising a minor proportion of a polymeric material and a major proportion of a tackifier therefor, evaporating volatiles therefrom, comminuting the product, compacting the coated refractory material in or on a pattern mold or core box, removing the mold or core thus formed from the pattern mold or core box and casting metal into the mold or around the core without an intervening curing step.

The invention further provides a composition for the production of foundry molds or cores comprising a granular refractory material and, as a dried contact adhesive coating thereon, a binder composition comprising a minor proportion of a polymeric material and a major proportion of a tackifier therefor. We have found surprisingly that the compositions of the invention retain their shape sufficiently to permit casting of molten metal. In contrast with the greensand process of the prior art, the process in accordance with the invention enables the production, by the application of simple pressure, of molds and cores having compressive strengths of the order of 300 – 700 kN/m$^2$ and, in addition, since the compositions contain no water, the casting defects which may arise in the conventional greensand molding process are avoided. In contrast to the foundry mold making processes which involve the setting or curing of resinous or silicate binders on the other hand, the compositions of the present invention do not require gassing or oven curing and have a substantially unlimitied bench life. Incorrectly made molds or cores produced with the composition of the present invention may be comminuted and reused without further treatment, since the adhesive properties of the binders are not lost through a thermosetting or curing process. Even after casting any portion of the mold or core which has not been completely burned out may be separated from burned-out sections and immediately reused to produce a new mold or core. A further advantage of the compositions in accordance with the invention is that all normal expansion can be accommodated without cracking.

In carrying the present invention into effect, the contact adhesive composition may be applied to the granular refractory material in any suitable manner which will provide a substantially even distribution of the adhesive over the surface of the refractory granules. Conveniently, this may be achieved by employing a solution or suspension of the adhesive composition in water or a volatile organic solvent and adding this gradually to the refractory material while agitating in a heavy duty mixer. If desired, the adhesive may be added in the form of a spray. The granular refractory material may be warmed prior to, during, or after the coating operation and cold or warm air blown onto or through the mixture to evaporate the volatile constituents.

Alternatively, a hot coating process may be used. In this case, the granular refractory material is heated to a temperature above the melting point of the adhesive composition used and the latter may, depending upon its composition and physical properties, be added as a solid or as a melt, although its addition in the form of a suspension or solution is preferred. In the case of the hot-coating process, the coated refractory material is preferably cooled immediately, conveniently in a cooling trough or disintegrator.

Whatever the coating method employed, the coated refractory material is preferably passed through a sieve to remove large agglomerates and stored in a fluidized storage bin to prevent subsequent reagglomeration prior to packing, if the material is not intended for immediate use.

Since the composition of the invention is contact sensitive, that is, the coated granules will adhere to one another upon application of pressure, it will be readily appreciated that agglomeration will occur whenever the composition is subjected to pressure. However, since the bond may be broken and remade repeatedly, this does not constitute a significant disadvantage. Nevertheless, for convenience in handling, it is preferred to pass agglomerated material through a disintegrator or picker shortly before use and to store the disintegrated material in a fluidized storage hopper.

The molding mixture may be conveyed to the mold-making station in any convenient manner. Excess of the mixture is charged into the molding box and the surplus levelled off and returned to the storage hopper. The molding mixture in the box is then subjected to pressure. This may be effected by handramming but better results are generally achieved by employing mechanical pressure as, for example, by using a jolt-squeeze machine. The mold so formed may be immediately removed from the pattern mold, the cope and drag assembled and employed in casting without further treatment.

It is within the ambit of the present invention, however, to submit the mold so formed to additional treatements prior to casting. In particular, conventional mold coatings or washes may be employed and the casting finish may be improved by dusting the casting surface of the mold with graphite or plumbago.

The casting is preferably knocked out immediately after solidification to minimize the volume of molding mixture burned out or degraded. The burned-out or degraded mixture is discarded and the residue, which remains moldable under pressure, may be returned to the storage hopper for re-use, after cooling, disintegrating and sieving.

The granular refractory material used in accordance with the invention may be any of the granular refractory materials commonly employed for the production of foundry molds or cores, such as silica sand, ground quartz, olivine, zircon sand, or mixtures thereof.

The polymeric material employed is preferably an elastomer, such as a natural or synthetic rubber, for example, butyl rubber, polyisoprene, styrene-butadiene copolymer, acrylic rubber, polyisobutylene, ethylene-propylene terpolymer rubber, nitrile rubber, polybutadiene, polyurethane rubber, epichlorhydrin rubber, chlorosulphonated polyethylene, polypropylene oxide rubber or polychloroprene. The tackifier may be any of the known tackifiers for rubber compositions, such as for example, gum rosin, wood rosin, rosin esters, hydrogenated, disproportionated and polymerized resins, polyterpene resins, coumarone or coumarone indene resins, hydrocarbon resins, condensation products of phenols with aldehydes, co-condensates of phenolic resins with coumarone-indene resins, pine oil distillation residues and factice.

In the compositions in accordance with the invention, the tackifier should constitute a major proportion, i.e. more than 50 percent by weight. This is distinct from the conventional practice in formulating contact adhesive compositions, in which a minor proportion of tackifier is generally employed. When such compositions are employed for coating refractory granules the mass cannot readily be reduced to a free-flowing condition and when subjected to pressure, produces soft, readily deformable molds having poor strength. By increasing the proportion of tackifier in accordance with the invention a coated refractory material is produced which exhibits a reduced tendency to agglomerate under light contact pressures but gives higher strengths when subjected to higher pressures. In consequence, the material may be readily reduced to a free-flowing condition, suitable for feeding into pattern molds or core boxes and enables cores or molds of adequate strength to be produced.

The compositions of the invention may also incorporate other additives. In particular, plasticizers or non-volatile solvents may be included to facilitate the self-adhesion of the coated granules under pressure. Such materials include, for example, dibutyl phthalate, polyglycols, oils, such as mineral oil, aromatic extracts and lanolin.

The inclusion of antioxidants may be desirable, particularly where the delay between the coating of the granules and the casting operation is likely to be prolonged.

On the other hand, or in addition, it may be desirable and is within the scope of the invention, to add oxidizing agents to the composition. This may be particularly desirable, for example, where the adhesive composition employed comprises materials which do not ignite readily and which give rise to noxious fumes as a result of degradation during the casting operation.

The properties of the binder compositions in accordance with the invention may be further modified, if desired, by incorporating a clay or other inorganic filler.

As to proportions, amounts of binder below about 0.5 percent by weight of the refractory material are generally inadequate to provide satisfactory strengths while amounts in excess of 10 percent are unnecessary and undesirable. We prefer to employ between 1 and 6 percent of binder, these amounts being expressed as weights of non-volatiles on the refractory material.

The following examples in which all parts are by weight, illustrate the invention.

EXAMPLE 1

Polychloroprene Binder 79.16 parts of polychloroprene were milled with 3.96 parts of Nonox WSP, 7.97 parts of light magnesium oxide and 1.06 parts of Aerosil. After milling, the rubber was allowed to cool and then remilled for 3–5 minutes with 7.91 parts of Colloid Zinc Oxide.

14.4 parts of Schenectady Resin SP-134 (a butylphenolformaldehyde resin) and 17.6 parts of Schenectady Resin SP-560 (a terpene phenolic resin) were dissolved 65.4 parts of toluene, heated to 60° C and 1.9 parts of light magnesium oxide added.

A contact cement was then prepared by dissolving 3.74 parts of the above milled polychloroprene, 16.79 parts of the above resin solution, 11.75 parts of unmilled polychloroprene and 2.05 parts of coumarone resin in 16.98 parts of toluene, 28.20 parts of SBP-2 (a solvent blend supplied by Carless, Capel & Leonard) and 15.49 parts of acetone. The resultant mixture is hereinafter referred to as Composition A.

Composition A was then blended with different amounts of a 23 percent solution of butylphenol formaldehyde resin as follows:

| Composition | B | C | D | E | F |
|---|---|---|---|---|---|
| Composition A | 90 | 70 | 50 | 40 | 30 |
| Butylphenol-formaldehyde resin solution | 10 | 30 | 50 | 60 | 70 |
| Tackifier/Polymer ratio | 0.7 | 1.2 | 2.0 | 2.8 | 4.1 |

1,000 parts of Chelford 50 sand were then heated to 200° C, charged into a heavy duty mixer heated to 80° C and allowed to cool to 160° C. 100 parts of one of the above compositions B to F were then charged while the mixer was in motion and mixed while a stream of hot air was blown over the surface to assist in removing volatiles. The mixing was continued until the odor of toluene was no longer detectable, whereupon the coated sand was discharged and allowed to cool. This procedure was then repeated for each of the remaining compositions. When cold, the sands coated with compositions D, E and R were sieved through a 20 mesh screen to produce free-flowing granules. Sands coated with compositions B and C were too sticky to permit sieving.

155 parts of each of the coated sands thus produced were charged into a 2 inch diameter hollow cylindrical mold and rammed 3, 6, 12 or 24 times with a 14 lb. weight falling through 2 inches. The test specimens thus prepared were then tested for compression strength with the following results:

| No. of rams | Compression strength kN/m² Composition D | E | F |
|---|---|---|---|
| 3 | 120 | 180 | |

-continued

| No. of rams | Compression strength kN/m² Composition D | E | F |
|---|---|---|---|
| 6 | 172.5 | 235 | Would not form core |
| 12 | 290 | 320 | |
| 24 | 420 | 435 | |

Cores made using Compositions D and E were broken down by hand and resieved through a 20 mesh screen. The core making process was then repeated and the following results obtained on testing:

| No. of rams | Compression Strength kN/m² Composition D | E |
|---|---|---|
| 3 | 140 | 180 |
| 6 | 210 | 265 |
| 12 | 305 | 320 |
| 24 | 395 | 440 |

A casting trial was carried out with satisfactory results using a mold prepared from Composition E.

(Nonox is a Registered Trade Mark of Imperial Chemical Industries Ltd. Nonox WSP is a phenolic antioxidant. Aerosil is a Registered Trade Mark of Degussa AG and relates to a finely divided silica. Schenectady Resins are supplied by Schenectady Midland Ltd.)

EXAMPLE 2

1,000 parts of Chelford 50 sand were coated as in Example 1 using a mixture comprising 40 parts of Composition A of Example 1, 60 parts of a 23% solution of butylphenol-formaldehyde resin in toluene and 2 parts of Poly-X-E43 (Poly-X is a Registered Trade Mark of Burmah Oil Co. Ltd. Poly-X-E43 is an aromatic extender oil for rubbers).

Compression test cores were made from this composition in the manner described in Example 1 using the composition immediately after sieving and after standing for 24 hours.

To test the re-usability of the molding mixture one sample was repeatedly crushed, resieved and remade 50 times. The following table shows the results obtained and indicates the negligible decrease in strength which occurs on repeated re-use.

| No. of rams | Compression Strength kN/m² Fresh | After 24 hours | Remade 10 | 20 | 30 | 40 | 50 times |
|---|---|---|---|---|---|---|---|
| 3 | 120 | 115 | — | — | — | — | — |
| 6 | 175 | 170 | — | — | — | — | — |
| 12 | 260 | 250 | 225 | 220 | 215 | 220 | 205 |
| 24 | 400 | 470 | — | — | — | — | — |

EXAMPLE 3

Petrosin 120, Petrosin 100 and Petrosin 80 were each dissolved in toluene to form 23 percent solutions. The three products are all tackifying resins based on $C_9$ hydrocarbons having ring and ball melting points of 120°, 100° and 80° C, respectively. 60 parts of each of these solutions were then mixed with 40 parts of Composition A of Example 1. Chelford 50 sand was then coated with each of these solutions separately, following the procedure described in Example 1, using 1,000 parts of sand and 100 parts of solution in each case. Test cores were then prepared as described in Example 1 and tested for compression strength with the following results:

| No. of rams | Melting point of tackifying resin: | Compression Strength kN/m² 80 | 100 | 120 |
|---|---|---|---|---|
| 3 | | 145 | 230 | 165 |
| 6 | | 215 | 285 | 360 |
| 12 | | 330 | 395 | 380 |
| 24 | | 425 | 650 | 475 |

EXAMPLE 4

A series of binder compositions was prepared by dissolving 20 parts of Breon 1001 in methyl ethyl ketone, adding 0.22 parts of Nonox WSL and blending with the amounts of a 23% solution of butylphenol-formaldehyde resin in toluene indicated below. The resultant binders were employed to coat sand as described in Example 1. Cores prepared using these compositions were tested and gave the results indicated in the following table:

| No. of rams | Mix: Breon solution / Butylphenol-Formaldehyde resin solution | Compression Strength kN/m² 40 / 60 | 30 / 70 | 20 / 80 |
|---|---|---|---|---|
| 3 | | 45 | 40 | 50 |
| 6 | | 70 | 100 | 85 |
| 12 | | 120 | 150 | 125 |
| 24 | | 180 | 220 | 195 |

(Breon is a Registered Trade Mark of British Geon Ltd. Breon 1001 is an acrylonitrile rubber. Nonox is a Registered Trade Mark of Imperial Chemical Industries Ltd. Nonox WSL is an antioxidant).

EXAMPLE 5

A series of binder compositions was prepared by mixing 60 parts of Composition A of Example 1 separately with 40 parts of a 23 percent solution of the following tackifiers.

1. Escorez 1102B — A hydrocarbon resin having a softening point of 100° C and a bromine number of 15.
2. Escorez 8100 — A polydiene hydrocarbon resin having a softening point similar to that of Escorez 1102B, but with a higher degree of unsaturation (Bromine number 60).
3. Chinese Gum Rosin
4. Coumarone Resin of melting point 125° C.
5. Epikote 1009 — a solid epoxide resin.

Each of the above tackifiers was dissolved in toluene, with the exception of Epikote 1009 which was dissolved in a mixture of equal parts of toluene and methyl ethyl ketone.

| No. of rams | Tackifier | Compression Strength kN/m² 1 | 2 | 3 | 4 | 5 |
|---|---|---|---|---|---|---|
| 3 | | 60 | 85 | 140 | 115 | 65 |
| 6 | | 130 | 140 | 230 | 190 | 80 |
| 12 | | 195 | 210 | 340 | 245 | 130 |

-continued

| No. of rams | Tackifier | Compression Strength kN/m² 1 | 2 | 3 | 4 | 5 |
|---|---|---|---|---|---|---|
| 24 | | 300 | 320 | 480 | 300 | 205 |

(Escorez is a Registered Trade Mark of Esso Chemical Ltd. Epikote is a Registered Trade Mark of Shell Chemical Co. Ltd.)

EXAMPLE 6

A 23 percent solution of Intol 1500 in toluene was prepared and mixed separately with 23 percent solutions of the tackifiers detailed below, using 25 parts of the Intol solution to 75 parts of each of the tackifier solutions. The results of compression tests effected as described in Example 1 are shown in the following table:

Tackifiers

1. C9 hydrocarbon resin. Melting point (ring and ball): 80° C.
2. C9 hydrocarbon resin. Melting point (ring and ball): 100° C.
3. C9 hydrocarbon resin. Melting point (ring and ball): 120° C.
4. Chinese Gum Rosin
5. Coumarone resin.

| No. of rams | Tackifier | Compression Strength kN/m² 1 | 2 | 3 | 4 | 5 |
|---|---|---|---|---|---|---|
| 3 | | 55 | 205 | 170 | 75 | 145 |
| 6 | | 90 | 305 | 275 | 135 | 240 |
| 12 | | 165 | 400 | 360 | 185 | 310 |
| 24 | | 230 | 490 | 475 | 285 | 440 |

(Intol is a Registered Trade Mark of the International Synthetic Rubber Company Ltd. Intol 1500 is a butadiene/styrene copolymer rubber.)

EXAMPLE 7

Example 6 was repeated with Tackifier 2 but employing Intol 1707 in place of Intol 1500. (Intol 1707 is a styrene/butadiene copolymer rubber extended with a naphthenic extender oil in the ratio rubber to oil 25–75).

| No. of rams | Compressive Strength kN/m² |
|---|---|
| 3 | 190 |
| 6 | 285 |
| 12 | 345 |
| 24 | 445 |

Obvious variations and modifications may be made within the spirit and scope of the following claims.

We claim:

1. A process for the production of foundry molds and cores which comprises coating a granular refractory material with a contact adhesive binder composition comprising a minor proportion of a polymeric material and a major proportion of a tackifier therefor, evaporating volatiles therefrom, comminuting the product, compacting the coated refractory material in or on a pattern mold or core box, removing the mold or core thus formed from the pattern mold or core box and casting metal into the mold or around the core without an intervening curing step.

2. A process according to claim 1, in which the coating of the granular refractory material is achieved by employing a mixture of the adhesive composition in a solvent and adding this gradually to the refractory material while agitating in a heavy duty mixer.

3. A process according to claim 2, in which the adhesive is added in the form of a spray.

4. A process according to claim 2, in which the granular refractory material is warmed prior to, during or after the coating operation and cold or warm air blown onto or through the mixture to evaporate the volatile constituents.

5. A process according to claim 1, in which coating of the granular refractory material is achieved by heating the material to a temperature above the melting point of the adhesive composition and adding the adhesive composition as a solid or as a melt.

6. A process according to claim 5, in which the coated refractory material is cooled immediately after the coating step.

* * * * *